US007178706B2

(12) United States Patent
Socha et al.

(10) Patent No.: US 7,178,706 B2
(45) Date of Patent: Feb. 20, 2007

(54) HEAVY-DUTY GARMENT HANGER

(76) Inventors: James L. Socha, HC 6 Box 827, Hemphill, TX (US) 75948; Quintin Socha, HC 6 Box 827, Hemphill, TX (US) 75948

( * ) Notice: Subject to any disclaimer, the term of this patent is extended or adjusted under 35 U.S.C. 154(b) by 193 days.

(21) Appl. No.: 10/954,266

(22) Filed: Oct. 1, 2004

(65) Prior Publication Data

US 2006/0071042 A1 Apr. 6, 2006

(51) Int. Cl.
*A41D 27/22* (2006.01)

(52) U.S. Cl. ..... 223/85; 223/88; 223/DIG. 4

(58) Field of Classification Search ..... 223/85, 223/88, 92, 95, 97
See application file for complete search history.

(56) References Cited

U.S. PATENT DOCUMENTS

| | | | | |
|---|---|---|---|---|
| 2,160,173 | A * | 5/1939 | Ruen | 223/92 |
| 2,170,319 | A * | 8/1939 | Cantwell | 223/88 |
| 2,493,131 | A * | 1/1950 | Gogol | 223/91 |
| 3,825,127 | A | 7/1974 | Morrison et al. | |
| 4,004,721 | A * | 1/1977 | Ross | 223/89 |
| 4,160,515 | A | 7/1979 | Frei | |
| 4,951,855 | A | 8/1990 | Jacobson et al. | |
| 4,978,043 | A | 12/1990 | Uke | |
| 5,052,599 | A * | 10/1991 | Platti | 223/89 |
| 5,277,345 | A | 1/1994 | Ozaki | |
| 5,398,984 | A | 3/1995 | Elder | |
| 5,480,076 | A | 1/1996 | Siegel et al. | |
| 5,806,727 | A | 9/1998 | Joseph | |
| 5,894,968 | A | 4/1999 | Christensen | |
| 5,950,882 | A * | 9/1999 | Scott | 223/85 |
| 6,032,838 | A | 3/2000 | Maher | |
| 6,149,020 | A | 11/2000 | Gumpel et al. | |
| 6,315,176 | B1 * | 11/2001 | Abdi | 223/85 |
| 6,672,491 | B1 | 1/2004 | Gugler | |
| 6,722,538 | B1 | 4/2004 | Autry et al. | |
| 2002/0108976 | A1 | 8/2002 | Carmichael | |
| 2003/0127578 | A1 | 7/2003 | Skorka | |
| 2004/0069819 | A1 | 4/2004 | Strouts | |

FOREIGN PATENT DOCUMENTS

| | | |
|---|---|---|
| DE | 41 19 185 A1 | 1/1992 |
| JP | 7-171045 | 7/1995 |
| JP | 2003-301244 | 10/2003 |

OTHER PUBLICATIONS userpages.cheshire.net/~hartwell/; Stainless Steel A.P.E. hanger; Jun. 8, 2003.

* cited by examiner

*Primary Examiner*—Gary L. Welch
*Assistant Examiner*—Nathan Durham
(74) *Attorney, Agent, or Firm*—Richard C. Litman

(57) ABSTRACT

The heavy-duty garment hanger is a hanger of hollow stainless steel construction, which can hold heavy articles of clothing. The hanger is made from hollow filamentous tubing shaped into an upwardly projecting hook adapted to engage a structure allowing the hanger to hang and a body having shoulder portions extending generally outwardly from the hook and an elongated cross member interconnecting the shoulder portions. A second length of hollow filamentous stainless steel tubing may be inserted and disposed concentrically within a portion of the first length of tubing, then bent to form the hook. A plug is inserted into the end of the hook.

13 Claims, 4 Drawing Sheets

HEAVY-DUTY GARMENT HANGER

BACKGROUND OF THE INVENTION

1. Field of the Invention

The present invention relates to garment hangers, and particularly to a heavy-duty garment hanger.

2. Description of the Related Art

Clothing hangers and coat hangers have been used for many years to support various articles of clothing. Wooden and light metal hangers are not expensive and are more than sufficient to hold most clothing articles. However, they generally do not have adequate strength to support very heavy pieces of clothing. For example, heavy suits, mink coats or firemen's jackets are all extremely bulky and likely to bend or break traditional clothing hangers.

Currently available heavy-duty garment hangers do not provide optimal strength in combination with lightweight construction. Conventional hangers made from materials sturdier than wire hangers are often quite heavy and also more expensive.

Wire hangers of metal construction have been known in the art for many years. For example, German Patent No. 4,119,185, published Jan. 23, 1992 (metal cot hanger with rotatable hook having thickened area at lower hook end to prevent sliding out); Japanese Patent No. 7-171,045, published Jul. 11, 1995 (metallic parts of hanger for clothing); Japanese Patent No. 2003-301,244, published Oct. 24, 2003 (high-strength stainless steel wire undetectable by needle detector, spring using this steel wire and spring product using this spring); and a web page published at the website userpages.cheshire.net/~hartwell/, dated Jun. 8, 2003 (stainless steel A.P.E. hanger) all disclose wire hangers.

There is a need for a heavy-duty garment hanger of lightweight construction, which is has sufficient strength to hold quite heavy articles of clothing. Thus, a heavy-duty garment hanger as described herein is desired.

SUMMARY OF THE INVENTION

The heavy-duty garment hanger is a hanger of a hollow stainless steel construction. The stainless steel construction allows the hanger to hold very heavy articles of clothing and is capable of supporting at least one hundred eighty pounds of weight without bending or breaking. The heavy-duty garment hanger is made from hollow tubing, so that the hanger is not excessively heavy.

The hanger is made from a length of hollow, continuous, filamentous stainless steel tubing. The hanger has an upwardly projecting hook and a body. The hook is adapted to engage a clothes rod or other structure supporting the hanger. The body has downward sloping shoulder portions extending generally outward from the hook. An elongated cross member interconnects the shoulder portions. The hanger shape is formed by bending the tubing and welding an end piece of the tubing to the top end of one of the shoulder portions at the base of the hook using a MIG welding process.

The body of the hanger is able to support an article of clothing, such as a fireman's coat. Shoulders of the coat are fitted over the body of the hanger. Stainless steel tubing is used because it is a very strong material, which is able to support heavy clothing articles. The stainless steel material renders the hanger essentially fireproof. Further, the stainless steel construction does not stain clothing hung on the hanger.

A plug may be inserted within a hollow end of the hook in order to prevent any sharp edges of the tubing from causing cuts or discomfort. In an additional embodiment, a second length of hollow filamentous stainless steel tubing is inserted and disposed concentrically or coaxially within the first length of tubing defining the hook portion. The addition of the second length of tubing increases the strength and rigidity of the hook portion, so that the hook is better able to withstand the load.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
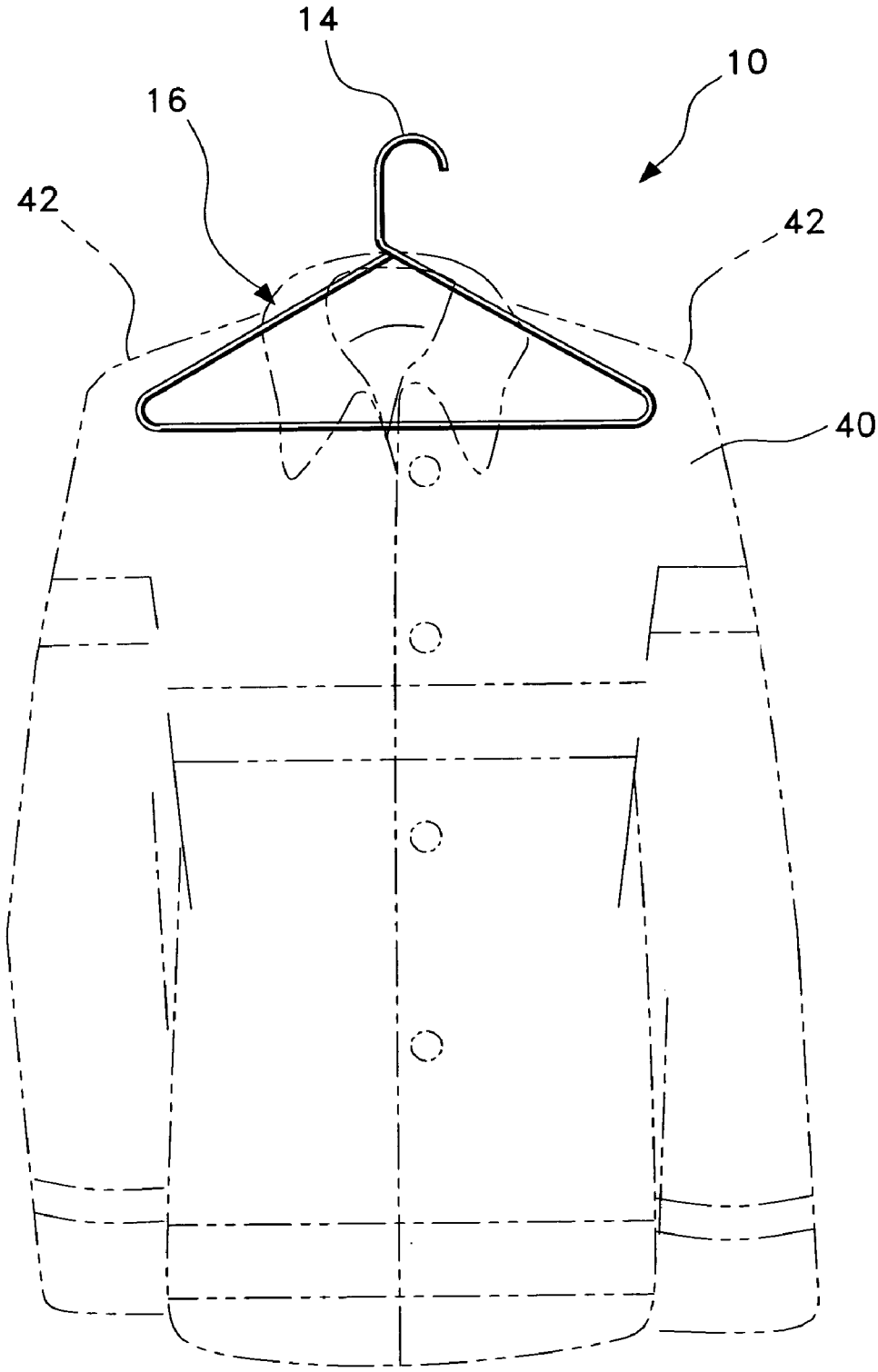
FIG. 1 is an environmental, perspective view of a heavy-duty garment hanger according to a first embodiment of the present invention.

The present invention is a heavy-duty garment hanger, designated generally as 10 in the drawings. The heavy-duty garment hanger 10 is made from stainless steel. The stainless steel construction allows the hanger 10 to hold very heavy articles of clothing and is capable of supporting at least one hundred eighty pounds of weight. The heavy-duty garment hanger 10 is made from hollow tubing, so that the hanger 10 is not excessively heavy.

Figure 2:
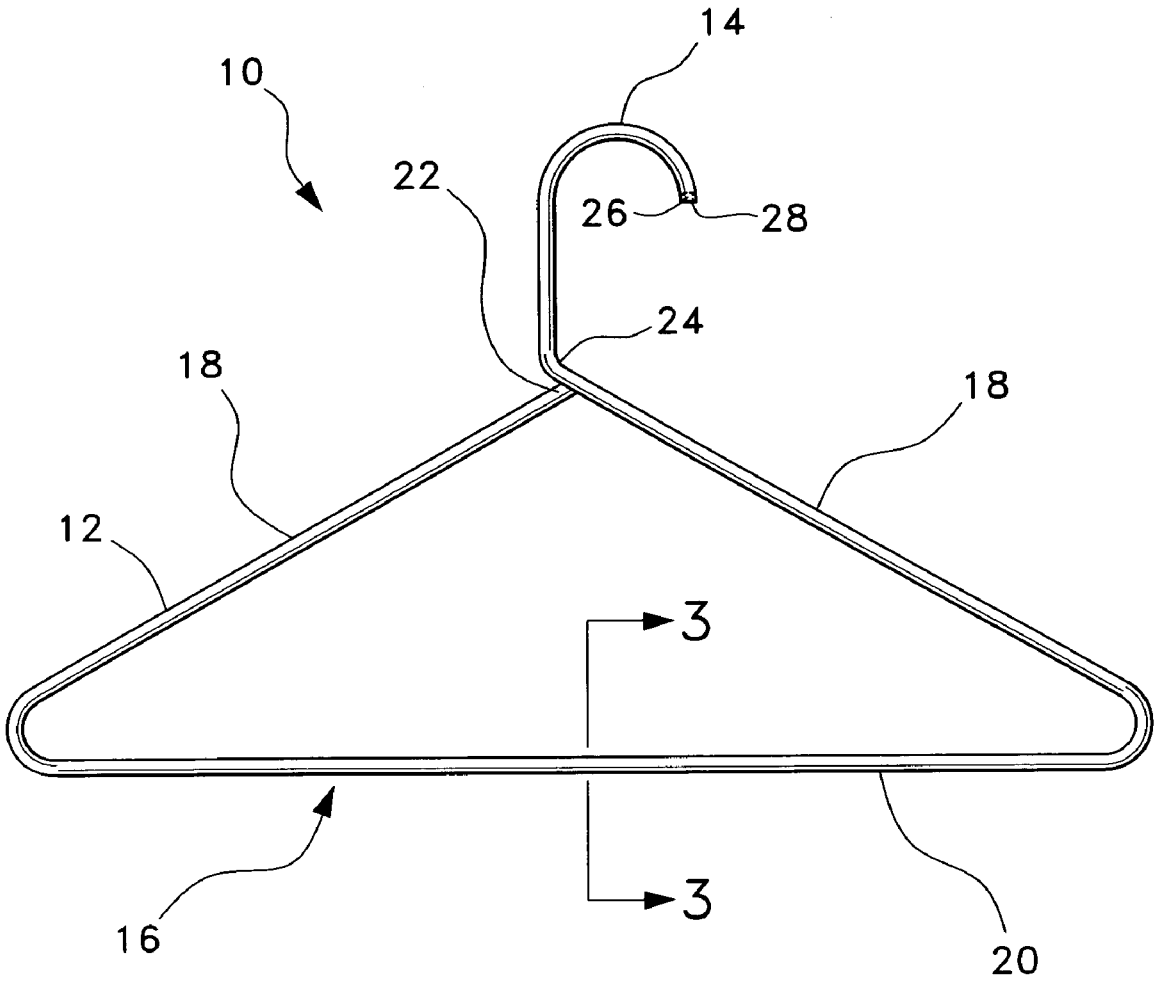
FIG. 2 is an elevational front view of the heavy-duty garment hanger according to the first embodiment of the present invention.

Referring first to FIGS. 1 and 2, the heavy-duty garment hanger 10 is shown holding a fireman's coat 40. Any heavy coat may be supported by the heavy-duty garment hanger 10. The hanger 10 is made from a first length of hollow filamentous stainless steel tubing 12. The hanger 10 has an upwardly projecting hook 14 and a body 16 depending from the hook 14. The hook 14 is adapted to engage a closet rod or other support structure, allowing the body 16 to hang below the support structure. The body 16 is capable of supporting an article of clothing, such as the fireman's coat 40. Shoulders 42 of the coat 30 are fitted over the body 16 of the hanger 10.

Stainless steel tubing 12 is used in the construction of the heavy-duty garment hanger 10 because it is a very strong material, which is able to support heavy clothing articles. The stainless steel material also renders the hanger 10 essentially fireproof. The stainless steel construction will not stain clothing hung on the hanger 10.

In forming the hanger 10, the tubing 12 is bent into a hanger shape having an upwardly extending hook 14 and a body 16 onto which the shoulders of the article of clothing are hung. The body 16 has a shoulder portions 18 extending generally outwardly from the hook 14 and an elongated cross member 20 interconnecting the shoulder portions 18. The tubing 12 is a continuous length. Once the tubing 12 is bent into a hanger shape, an end piece 22 of the tubing 12 is welded to the top end 24 of one of the shoulder portions 18 at the base of the hook 14 using a MIG welding process.

Additionally, a plug 26 may be inserted within a hollow end 28 of the hook 14 so that the end 28 of the hook 14, and particularly the sharp edges of the tubing, does not snag on garments, or scratch, cut, or otherwise cause any discomfort during use of the hanger 10.

Figure 3:
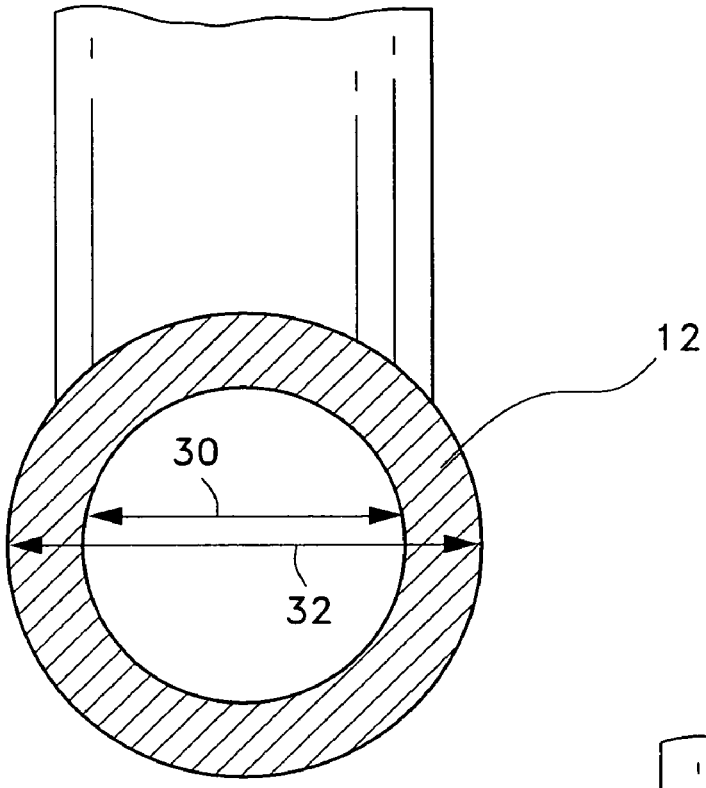
FIG. 3 is a section view drawn along lines 3—3 of FIG. 2 of the heavy-duty garment hanger according to the first embodiment of the present invention.

FIG. 3 shows a section view along the lines of 3—3 in FIG. 2. The tubing 12 has an inside diameter 30, which may be about five-sixteenths of an inch. The tubing 12 has an outside diameter 32 of about three-eighths of an inch. The inside 30 and outside 32 diameters are not limited to five-sixteenths and three-eighths of an inch, respectively. The diameters 30 and 32 may be greater than or less than the five-sixteenths and three-eighths inch diameters, the recited diameters merely indicating representative relative dimensions. The tubing 12 is hollow so that the hanger 10 may be more lightweight than if the hanger 10 were solid.

Figure 4:
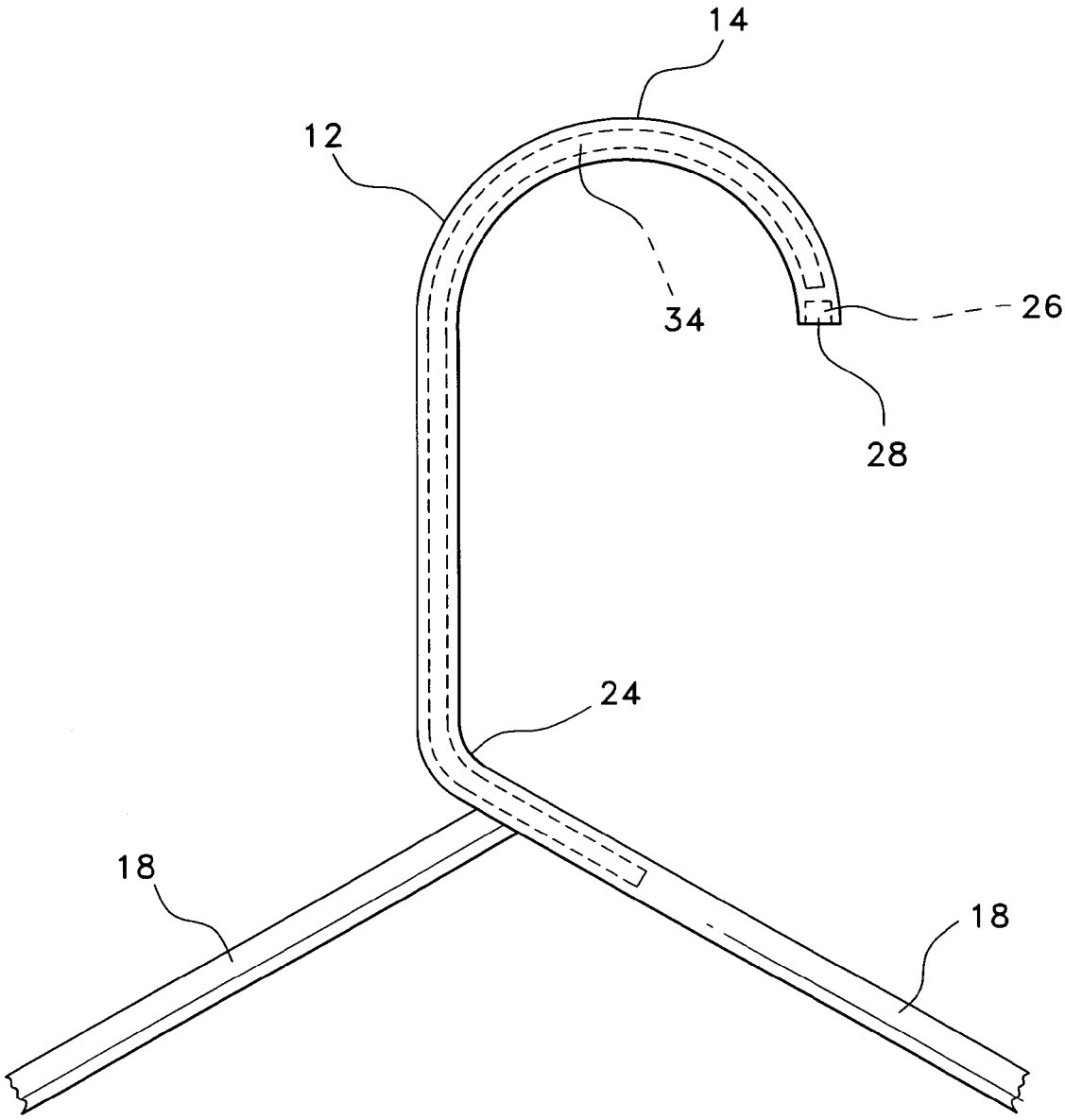
FIG. 4 is a fragmented, elevational front view of the heavy-duty garment hanger according to a second embodiment of the present invention, showing coaxial lengths of tubing in the hook.

FIG. 4 shows a fragmentary view of a portion of a second embodiment of the hanger 10. A second length of hollow filamentous stainless steel tubing 34 is inserted within a portion of the first length of tubing 12 prior to bending the tubing 12 into a hanger shape. The second length of tubing 34 is disposed concentrically or coaxially within the hook portion 14 of the hanger 10, and extended approximately one inch past the upper end 24 of one of the shoulder portions 18. The hanger 10 is then bent into the correct shape. The second length of tubing 34 provides the hook 14 with even greater strength when hung from a structure, since the hook 14 must support the combined load applied to both shoulder portions 18. Although the second length of tubing 34 is shown within the hook 14, it may alternatively extend throughout the entire hanger 10. The plug 26 is held within the hollow end 28 of the tubing 12.

Figure 5:
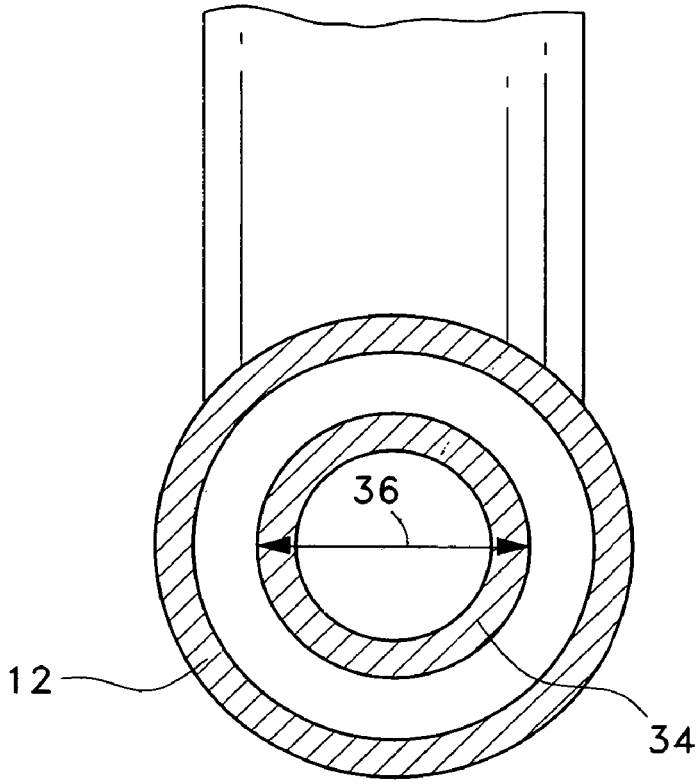
FIG. 5 is a transverse section view drawn through the hook of FIG. 4, showing the concentric tubing in the hook portion of the heavy-duty garment hanger according to the second embodiment of the present invention.

FIG. 5 shows a section view through the hook 14. The second length of hollow filamentous stainless steel tubing 34 is inserted and disposed concentrically within the first length of tubing 12. The second length of tubing 34 has an outside diameter 36 of one-quarter of an inch. The outside diameter 36 of the second length of tubing 34 is not limited to one-quarter of an inch, this dimension being representative only. The diameter 36 may be greater than or less than the one-quarter inch diameter, depending upon the inside diameter 30 of outer tubing 12.

It is to be understood that the present invention is not limited to the embodiments described above, but encompasses any and all embodiments within the scope of the following claims.

We claim:

1. A heavy-duty garment hanger, comprising:

a hook adapted to engage a support structure;

a body depending from the hook and adapted for supporting a garment, the hook and the body being made from a single first length of filamentous tubing; and a second length of filamentous stainless steel tubing disposed concentrically within at least a portion of the first length of tubing defining the hook.

2. The heavy-duty garment hanger according to claim 1, wherein the body is formed with opposing shoulder portions extending generally outwardly from the hook and an elongated cross member interconnecting the shoulder portions, defining a generally triangular shape, the tubing having an end welded at a base of the hook to form the triangular shape.

3. The heavy-duty garment hanger according to claim 1, wherein the second length of tubing has an outside diameter of ¼ of an inch.

4. The heavy-duty garment hanger according to claim 1, wherein the first length of tubing has an inside diameter of 5/16 of an inch.

5. The heavy-duty garment hanger according to claim 1, wherein the first length of tubing has an outside diameter of ⅜ of an inch.

6. The heavy-duty garment hanger according to claim 1, further comprising a plug inserted into an end of the hook.

7. The heavy-duty garment hanger according to claim 1, wherein said first length of tubing is made from stainless steel.

8. A heavy-duty garment hanger, comprising:

a hook adapted to engage a support structure;

a body depending from the hook and adapted for supporting a garment, the hook and the body being made from a single first length of filamentous stainless steel; and a second length of hollow filamentous stainless steel tubing disposed concentrically within at least a portion of the first length of stainless steel tubing defining the hook.

9. The heavy-duty garment hanger according to claim 8, wherein said first length of filamentous stainless steel comprises hollow tubing.

10. The heavy-duty garment hanger according to claim 8, wherein said body comprises opposing shoulder portions and a cross member extending between the shoulder portions to define a generally triangular shape, one of the shoulder portions having an end welded to a base of said hook to close the triangle.

11. The heavy-duty garment hanger according to claim 8, further comprising a plug inserted into an end of said hook.

12. A method of making a heavy-duty garment hanger, the method comprising the steps of:

providing a first hollow length of tubing and a second length of stainless steel tubing;

inserting the second length of stainless steel tubing concentrically within the first length of tubing;

bending the first and the second concentric lengths of tubing to form a hook having a base;

bending the first length of tubing to form a first shoulder portion extending from the base, a cross member extending below the base, and then into an opposing second shoulder portion having an end at the base of the hook, the opposing shoulder portions and the cross member forming a generally triangular shape; and welding the end of the second shoulder portion to the base of the hook.

13. The method of making a heavy-duty garment hanger according to claim 12, further comprising the step of inserting a plug into an end of the hook.

* * * * *